United States Patent [19]

Price

[11] Patent Number: 4,666,100

[45] Date of Patent: May 19, 1987

[54] BELT CORE

[76] Inventor: John G. Price, P.O. Box 17689, Montgomery, Ala. 30117

[21] Appl. No.: 804,601

[22] Filed: Dec. 4, 1985

[51] Int. Cl.[4] ..... B65H 75/28; B65H 18/02

[52] U.S. Cl. ..... 242/68.5; 242/74

[58] Field of Search ..... 242/68.5, 68.6, 74, 242/67

[56] References Cited

U.S. PATENT DOCUMENTS

| | | | |
|---|---|---|---|
| 355,145 | 12/1886 | Davis et al. | 242/68.6 |
| 730,239 | 6/1903 | Davis | 242/55.3 |
| 1,222,943 | 4/1917 | Gammeter | 242/68.6 |
| 3,361,380 | 1/1968 | Mizutani | 242/74 |
| 3,604,651 | 9/1971 | Ohno | 242/74 |
| 3,620,469 | 11/1971 | Riedel | 242/74 |
| 3,782,651 | 1/1974 | Hengelhaupt | 242/74 |
| 4,226,382 | 10/1980 | Watanabe | 242/74 |
| 4,266,738 | 5/1981 | Nakagawa | 242/74.1 |
| 4,436,253 | 3/1984 | Watanabe | 242/74 |

*Primary Examiner*—Stuart S. Levy

*Assistant Examiner*—Katherine Matecki

*Attorney, Agent, or Firm*—Sherman & Shalloway

[57] ABSTRACT

Disclosed is an improved belt core which may be utilized so as to facilitate the winding up of an elongated belt such as, for example, a belt of rubber into a roll for shipping purposes. The inventive core includes a central hole of non-circular shape so that a corresponding non-circular winding shaft may be placed therein. Further, the core includes a recess having a sawtoothed configuration into which recess the end of the belt may be placed so as to retain it on the the core and a plurality of additional recesses which are sized so as to receive therein standard pieces of wood to which may be attached the end of the belt in an alternative manner of attachment of the belt to the core. In one aspect of the present invention, two cores in accordance with the invention may be utilized one at each of the lateral sides of the belt, which cores may be connected together by elongated pieces of wood so as to facilitate the forming of a roll of belt material.

6 Claims, 3 Drawing Figures

BELT CORE

BACKGROUND OF THE INVENTION

The present invention relates to an improved belt core. For shipping purposes, heavy belting must be rolled up on a core device which is customarily made from metal or wood or in some cases sawdust combined with epoxy resins. Experience with rolling up of heavy belting on cores has revealed that since many types of belting are heavy, wood is not a strong enough material for use in making a core. Furthermore, wood is quite expensive and must be fabricated into a shape which will accomodate the roll of belt, therefore, usually a wooden box that will accomodate the square shaft of the windup machine is fabricated of sufficient length to extend to the laterial sides of the rolled up belt, or otherwise, wooden belt cores are cut from lumber and are formed with a non-circular hole in the middle thereof which may be lined up with the correspondingly configured shaft with as many cores being used as are necessary to handle the anticipated weight of the roll.

In most instances, when metal has been used to manufacture the core, the core generally comprises a piece of pipe which is cut to the appropriate length, has a non-ciruclar hole therethrough formed by adapter plates welded into each end and each having the hole therethrough, and further including a slot usually torched into the side of the pipe so as to enable the tucking of the end of the belt therein to start the roll. Metal cores made in this fashion are extremely expensive due to the large expense of pipes of that size, and in view of the labor involved in torching the slot and welding the adapter plates, the use of a metal pipe in this fashion is not practical.

As stated above, another material which may be utilized in making a core is sawdust which has been combined with epoxy resins and cast into the core in continuous lengths up to, for example, six feet long, and including a non-circular hole therethrough. When sawdust cores are used, the belt end is attached to the core by nails or other means and then the belt is wound up thereon. As is the case with the metallic pipe described above, cores made of the sawdust-epoxy resin combination are expensive and have also been found to be brittle. Because of this brittleness, sawdust-epoxy resin cores tend to break up when the belt ends are attached thereto by nailing, so they are generally not usable and furthermore due to the nature of the epoxy resin material, these cores are difficult to cut to the desired length.

The following prior art references are known to Applicant:

U.S. Pat. No. 355,145 to Davis, et al. teaches the concept of a core device having a square opening therethrough for winding purposes. This patent is believed to be of only general interest concerning the teachings of the present invention since, of course, the present invention may utilize an opening therethrough of any shape which is compatible with a device for winding the core and the belt attached thereto.

Each of U.S. Pat. Nos. 730,239 to Davis and 1,147,875 to Connerman teaches a core device having a retention member including a plurality of teeth which enhance the retention thereof. The present invention is distinct from each of these patents since in each of these patents, the teeth are on moving members which rely upon mechanical activation to lock the belt end therein. In the present invention, the teeth which are used are passive and require no mechanical mechanism, but rather rely upon the tension of the winding procedure to make the teeth grip the belt end.

U.S. Pat. No. 3,361,380 to Mizutani discloses a spool for photographic film which includes a recess having teeth therein for retention purposes. The present invention differs from the teachings of Mizutani since, in fact, the teeth thereof are really hooks which are utilized to engage pre-formed holes in the end of the film so as to retain the film thereon. In the present invention, no end preparation of the material which is being rolled up is required.

U.S. Pat. No. 3,782,651 to Henglehaupt discloses a spool having a curved groove which is utilized to carry a ribbon from one location to another. Since the curved groove does not perform the retention functions performed by the recess of the present invention, this patent is believed to be of only general interest concerning the teachings of the present invention.

U.S. Pat. No. 4,266,738 to Nakagawa discloses a tape reel having a recess formed by a pivotal member including interengagable teeth which are utilized to retain the tape therein. This device is similar to Davis and Connerman discussed above since the Nakagawa device uses a movable member including teeth whereas in the present invention the teeth are completely passive and stationary.

U.S. Pat. Nos. 3,620,469 to Riedel, et al. and 4,436,253 to Watanabe each disclose a reel having a peripheral recess into which may be frictionally retained a plug member so as to enable the retention therein of the material which is to be wound up on the reel. This is believed different from the teachings of the present invention since in the present invention the peripheral recesses which are disclosed are utilized so as to enable the insertion therein of standard size wood pieces onto which the belt end may be attached.

Accordingly, a need has developed for a simple belt core device which is cheap enough to manufacture so that it may be disposable, that is, the shipper of belt products who provides the belt cores need not worry about charging the customer for the cores or about the expense of having the cores returned. In this light, and in order to overcome all of the deficiencies of the prior art as set forth above, the present invention was developed.

SUMMARY OF THE INVENTION

The inventive belt core of the present invention is specifically designed to overcome all the deficiencies in the prior art as set forth above and to provide a single use product which may be discarded after its single use due to the low cost of manufacture thereof. The present invention includes the following combination of features and aspects:

(a) In a first aspect of the present invention, the inventive core is made of a inexpensive material and through an inexpensive manufacturing process. In the preferred embodiment of the present invention, the inventive belt core is made of cast iron.

(b) In a further aspect of the present invention, the inventive core has a hole through the middle thereof which in the preferred embodiment is non-circular in perimeter so that it may engage a winding shaft so as to enable the core to be rotated to wind a belt thereon. Any shape opening may be utilized so long as it is compatible with the winding shaft which is to be used.

(c) In a further aspect of the present invention, a recess is formed in the inventive core which extends from the periphery of the core inwardly in a oblique fashion between the axis of rotation of the core and the outer periphery. In the preferred embodiment, this recess has on one of its surfaces a series of teeth and is further configured to be wedge-shaped so that the end of the belt which is to be wound upon the core may be wedged therein and retained by the teeth.

(d) In a further aspect, the inventive core may include one or more additional recesses in its periphery spaced about the circumference thereof. These recesses may be sized, if desired, so as to correspond to the peripheral dimensions of a piece of wood such as a "2×4". Thus, such a piece of wood may be placed into one of these recesses and the belt end may be affixed thereto by fastening devices well known in the art such as, for example, nails so as to enable the belt end to be fixed with respect to the inventive core.

(e) In a further aspect of the present invention, with further reference to the latter-mentioned recesses, a plurality of belt cores in accordance with the present invention may be utilized for use in winding up a laterally elongated belt. Thus, for example, two inventive belt cores may be utilized and spaced at opposed lateral ends of the belt end and may be interconnected to one another by inserting straight pieces of wood into the latter-mentioned recesses, whereupon the belt end may be affixed thereto and thereafter the belt may be wound upon the device formed by the wood pieces and the two cores. When the lateral elongation of the belt is large, more than two belt cores may be used so long as care is taken to ensure that proper alignment is maintained between the various sides of the central openings of the respective cores.

Accordingly, it is an object of the present invention to provide a new and improved belt core which overcomes the deficiencies of the prior art as set forth hereinabove.

It is a further object of the present invention to provide a belt core which is easily and inexpensively manufactured and which may be discarded after its single use.

It is a still further object of the present invention to provide such a belt core including a plurality of means associated therewith for attaching the end of a belt thereon which is to be rolled thereover.

It is a still further object of the present invention to provide such a belt core including a central opening therethrough, preferably of non-circular shape, which may interface with a rotary shaft so as to enable a belt of material to be rolled thereover.

These and other objects, aspects and features of the present invention will be better understood with reference to the following detailed description of the preferred embodiments when read in conjunction with the appended drawing figures.

SPECIFIC DESCRIPTION OF THE PREFERRED EMBODIMENTS

Figure 1:
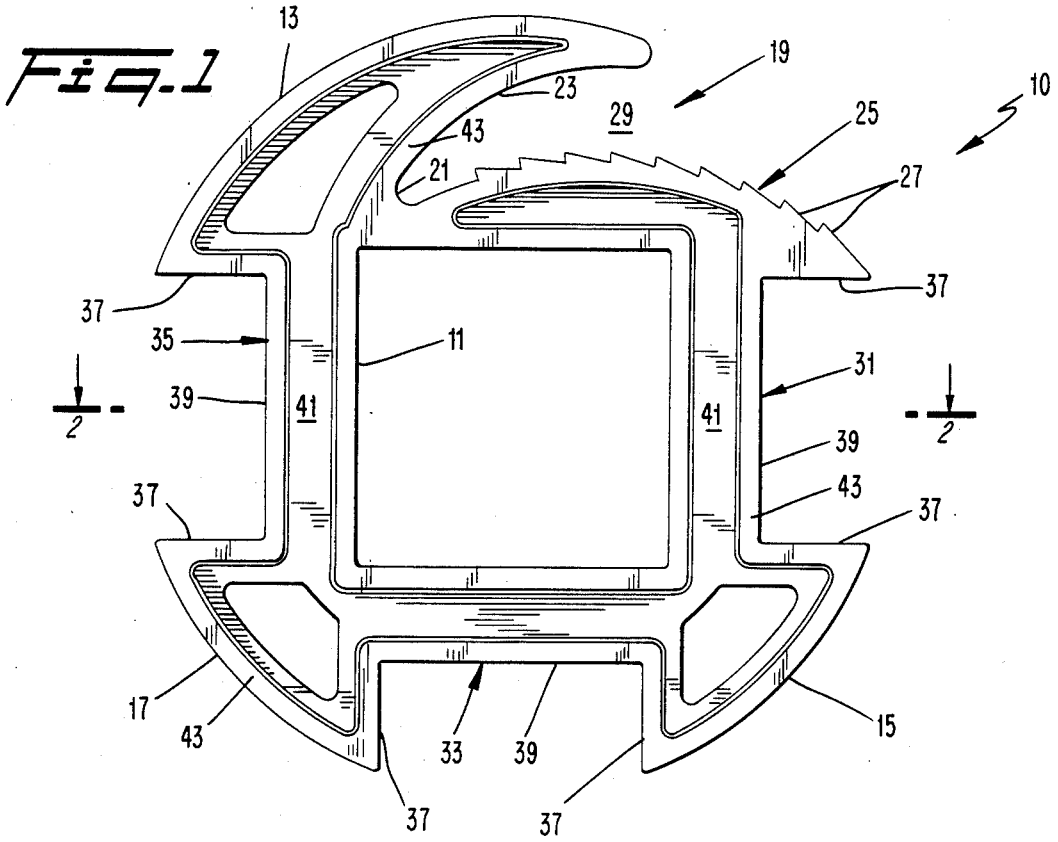
FIG. 1 shows a side view of the preferred embodiment of the preferred invention.

With reference first to FIG. 1, in the preferred embodiment of the belt core 10, a central opening 11 is formed therethrough which central opening is of a non-circular configuration so that it may mesh with a correspondingly shaped rotary shaft device so as to enable the core 10 to be rotated by this shaft (not shown). As shown in FIG. 1, the central opening 11 may be of square configuration, however, this is merely to be considered as an example of the many shapes with which the central opening 11 may be made. While non-ciruclar configurations are preferred, it is even possible to make the central opening 11 of circular cross-section so long as the added provision of a set screw (not shown) is provided in the belt core 10 so as to enable the locking of the shaft (not shown) thereto.

With further reference to FIG. 1, the core 10 includes a generally circular outer periphery as defined by the peripheral portions 13, 15 and 17. Between the peripheral portions 13 and 15, a recess 19 is provided which extends from the periphery of the core 10 and in a curved manner into the core 10 in an oblique direction to terminate at an end 21 spaced somewhere between the peripheral portion 13 and the central opening 11. The recess 19 is defined by an arcuate surface 23, the end portion 21 and a toothed surface 25 having a plurality of teeth 27 formed thereon which face in a direction toward the end portion 21 of the recess 19.

As may be seen especially in FIG. 1, the recess 19 constricts from its largest area at the mouth 29 to its smallest area immediately adjacent the end portion 21 so that as one moves from the mouth 29 to the end portion 21, the recess 19 becomes more and more constricted in its dimensions. Thus, when the end of a belt which is to be wound upon the belt core 10 is inserted into the recess 19, as the end gets closer to the end portion 21, the end is increasingly wedged into the recess 19 so as to be retained therein. In this regard, once the end of the belt is wedged into the recess 19, the teeth 27, which as stated above face the end portion 21, act to maintain the end of the belt in the recess 19 by digging into the belt end surface. This static retention means consisting of the shape of the recess 19 and the cooperation of the teeth 27 with the belt end, results in a static retention means which is simple and effective in maintaining the end of the belt securely mounted to the core 10.

With further reference to FIG. 1, it is seen that into the outer periphery of the core 10, three additional recesses designated by the reference numerals 31, 33 and 35 are formed. Each of these recesses is substantially rectangular in configuration having two short sides 37 connected together by an elongated side 39. These recesses 31, 33 and 35 are provided so as to enable the end of the belt to be aftached in association with the core 10 by another means if desired.

In the particular embodiment shown in FIG. 1, the recesses 31, 33 and 35 are particularly sized so as to each be able to receive snugly therein a piece of wood known in the art as a "2×4". Thus, such a "2×4" may be placed in one of the recesses 31, 33 or 35 or in more than one of these recesses and the belt end may then be attached to the piece or pieces of wood by any conventional means such as nails, brads, etc., whereupon the core 10 may be rotated by the associated shaft (not shown) to enable the belt to be rolled up thereon.

Again, it is stressed that the particular dimensions of the recesses 31,33 and 35 as shown in FIG. 1 are merely to be considered exemplary. In this regard, these recesses may be made of any configuration desired so as to enable their snug interaction with any standard or non-standard piece of wood.

Figure 2:
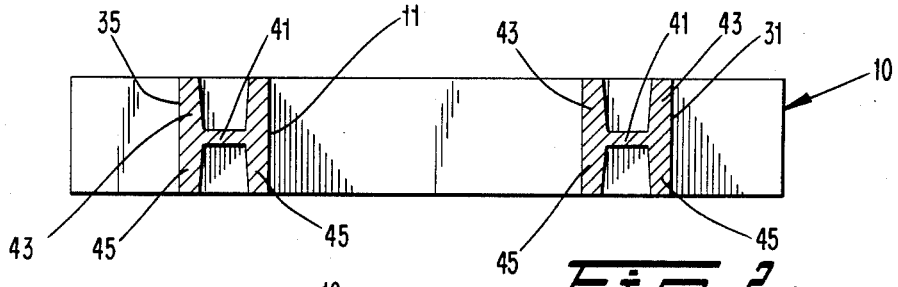
FIG. 2 shows a cross-sectional view along the line 2—2 of FIG. 1.

Reference is now made to FIG. 2 which shows the core 10 with its central opening 11 and recesses 31 and 35. FIG. 2 illustrates one manner of construction of the inventive core 10, to wit, as a cast iron construction. Thus, as shown in FIG. 2, the core 10 includes a centrally located flat base portion 41 also shown in FIG. 1 and further includes upstanding structure in the form of continuous ribs 43 and 45 extending both upwardly and downwardly from the structure 41. In FIG. 1, only the ribs 43 are shown. Of course, as is known to those skilled in the art, the core 10 is made in this manner both to save on materials and to increase the structural rigidly of the core 10 while at the same time preventing warping and bending which could occur if the core 10 were to be made as a solid piece without the rib structure.

Figure 3:
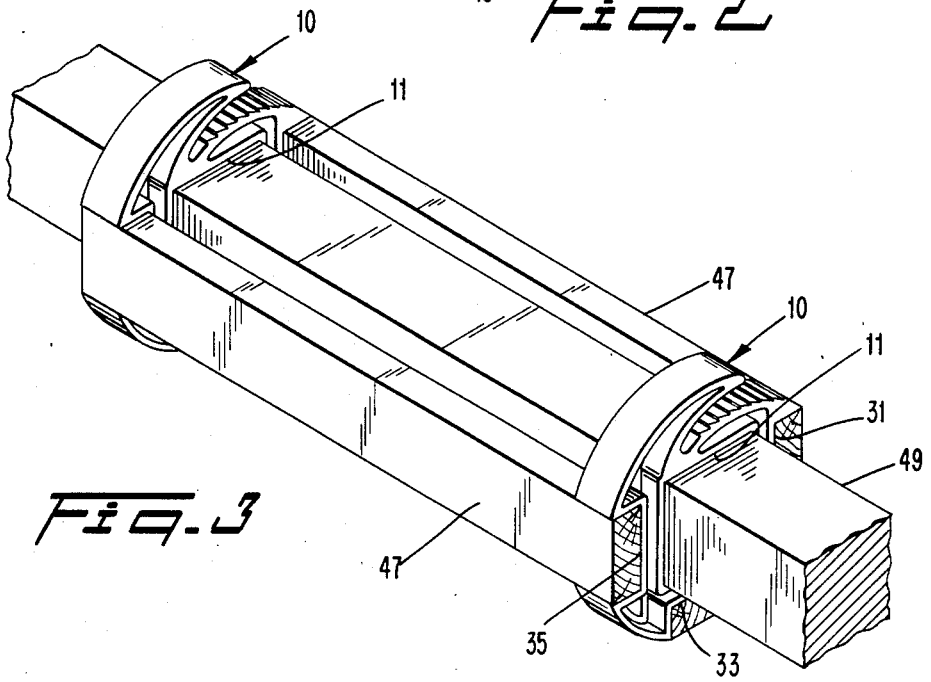
FIG. 3 shows a perspective view of two belt cores as illustrated in FIGS. 1 and 2 attached together to form an elongated core device in accordance with the teachings of the present invention.

Referring now to FIG. 3, an example of the use of the present invention is shown wherein two cores 10 are interconnected by a plurality of "2×4"'s designated in the figure by the reference numeral 47. Thus, as shown in FIG. 3, the "2×4"'s are inserted into the respective recesses 31, 33 and 35 which recesses are configured so that the "2×4"'s are frictionally retained therein. Then, the end of the belt may be secured to one of the "2×4"'s, for example the one contained within the recesses 31 and as the belt is wound about the cores 10 through a first revolution thereof, for additional rigidity those portions of the belt end immediately adjacent thereto may also be attached to the "2×4"'s overlying the recesses 33 and 35. Thereafter, the shaft 49 may be rotated by suitable means (not shown) so as to rotate the cores 10 and to thereby roll the belt up into a roll.

When rolling up belts having lateral widths of large dimension, additional belt cores 10 may be utilized between those belt cores which are located at the extreme lateral end of the belt. Thus, in the example shown in FIG. 3, one or more additional cores 10 may be placed between the cores shown in the figure for added stability and rigidity.

In the preferred embodiment of the present invention, for purposes of economy and for weight considerations, the belt cores 10 may be made of cast iron with the rib structure shown best in FIG. 2. Of course, depending upon the application, the belt core 10 in accordance with the present invention may also be made of wood, plastic, sawdust combined with epoxy resins, or any other desired material. The only limitations on the materials are those which might prevent its use under the force considerations contemplated and the anticipated expenses. Accordingly, an invention has been disclosed hereinabove in terms of a preferred embodiment thereof which fulfills each and every one of the objectives as set forth hereinabove. Of course, various changes, modifications, and alterations in the teachings of the present invention may be contemplated by those skilled in the art without departing from the intended spirit and scope of the present invention. Accordingly, it is intended that the present invention only be limited by the terms of the following claims.

I claim:

1. An improved belt core comprising:

(a) a first one piece belt core body with a generally circular periphery having a non-circular central opening therethrough sized to drivingly receive a rotary shaft substantially complimentary thereto;

(b) first recess means having an opening and a closed end and being of a wedge-shaped fixed immovable configuration having a plurality of teeth means facing said closed end for frictionally retaining an end of a belt which is to be rolled up over said core between said teeth means and an adjacent surface in said first recess means;

(c) second recess means substantially completely opening in a radially outward direction of said body for removably receiving attachment means, said belt being attachable to said attachment means for retaining said belt on said core.

2. The invention of claim 1, wherein said second recess means comprises at least one recess of substantially rectangular configuration, said recess being sized to receive a piece of wood comprising said attachment means therein, said belt being attached to said piece of wood.

3. The invention of claim 2, wherein said second recess means comprises a plurality of recesses.

4. The invention of claim 1, wherein said belt core comprises said first one piece, and further including a second belt core body substantially identical to said first one piece belt core body, said bodies being combined together by inserting said shaft through the non-circular central openings of said bodies to form said belt core.

5. The invention of claim 4 wherein each said belt core body includes a said second recess means, each said second recess means comprising at least one recess of substantially rectangular configuration, said attachment means being releasably engaged with each said second recess means to further combine said belt core bodies together along with said shaft to form said belt core.

6. The invention of claim 1, wherein said teeth means are located on a further surface, said adjacent surface and said further surface comprising curved surfaces converging to said closed end.

* * * * *

UNITED STATES PATENT AND TRADEMARK OFFICE

CERTIFICATE OF CORRECTION

PATENT NO. : 4,666,100

DATED : May 19, 1987

INVENTOR(S) : JOHN G. PRICE

It is certified that error appears in the above-identified patent and that said Letters Patent is hereby corrected as shown below:

IN THE CLAIMS

Column 6, line 38, claim 4, after "piece", insert --belt core body--.

Signed and Sealed this

Seventeenth Day of November, 1987

*Attest:*

DONALD J. QUIGG

*Attesting Officer*

*Commissioner of Patents and Trademarks*